United States Patent [19]

Anderson

[11] 4,261,602

[45] Apr. 14, 1981

[54] SECURITY LOCK

[75] Inventor: Donald L. Anderson, Owatonna, Minn.

[73] Assignee: Truth Incorporated, Owatoona, Minn.

[21] Appl. No.: 4,362

[22] Filed: Jan. 18, 1979

[51] Int. Cl.[3] ..... E05C 1/06

[52] U.S. Cl. ..... 292/143; 292/337

[58] Field of Search ..... 292/143, DIG. 49, 140, 292/161, 173, 347, 337

[56] References Cited

U.S. PATENT DOCUMENTS

| | | | |
|---|---|---|---|
| 331,005 | 11/1885 | Sahr . | |
| 331,995 | 12/1885 | Mumma . | |
| 476,434 | 6/1892 | Westberg . | |
| 800,043 | 9/1905 | Witte | 292/143 |
| 3,762,750 | 10/1973 | Orr | 292/140 |

FOREIGN PATENT DOCUMENTS

| | | | |
|---|---|---|---|
| 563455 | 8/1944 | United Kingdom | 292/143 |

*Primary Examiner*—Richard E. Moore

*Attorney, Agent, or Firm*—Wegner, Stellman, McCord, Wiles & Wood

[57] ABSTRACT

A security lock for movable closure and, more particularly, for horizontal slider windows in which a case for the lock has a top wall and side walls defining a generally hollow interior opening to the bottom of the case, a bolt is movably mounted in a channel formed within the case with the channel opening toward the bottom of the case. The bolt is movable between extended and retracted positions. Structure for positioning of the bolt includes a driver associated with a manually-rotatable shaft and a connection between the driven and the bolt which functions to retain the bolt from falling out of the guide channel through the open bottom of the case during handling and shipping and to also transmit movement of the shaft to the bolt.

9 Claims, 8 Drawing Figures

2.
70
15
10
11
42
12
30
71
19
2.

18
3
12
70
63
42
41
40
50
45
51
26
30
31
15
25
71
19
3.

18
65
64
70
63
50
16
62
52
60
17
61
26
30
31
55
19

18
65
64
70
63
16
17
62
60
50
61
52
26
55
30
31
19

SECURITY LOCK

BACKGROUND OF THE INVENTION

This invention pertains to a security lock as usable with horizontal slider windows for retaining the window in a closed, locked position.

It is generally known in the art to lock a closure, such as a door or window, by means of a bolt which can be moved between extended and retracted positions. Such structure includes a case which movably mounts the bolt and which has structure internally of the case responsive to manual operation, as by rotation of a shaft, for controlling the position of the bolt. In the prior art, the case has had a top wall and side walls and also a bottom wall as provided by a plate secured to the case to retain the bolt and operating parts within the case primarily during shipment and installation of the structure. The use of a bottom plate to completely enclose the case results in additional structure and cost for the unit and can also result in increased height of the case unless special provision is made for mounting the bottom plate in recessed relation with respect to the side walls of the case.

SUMMARY OF THE INVENTION

A primary feature of the invention disclosed herein is to provide a security lock wherein the case has an open bottom and the bolt and operating structure therefor are constructed and assembled in a manner to provide for retention of the parts within the case without the necessity for a bottom plate to enclose the case.

More particularly, the security lock embodies a case with a top wall and side walls with an internal channel opening toward the open bottom of the case and which movably receives a bolt which is movable between extended and retracted positions. Manually-operable structure is associated with the case for positioning of the bolt and includes a shaft rotatably mounted in the case and means including a member fixed to the shaft for transmitting shaft movement to the bolt and said member being fixed to the shaft in a position whereby said means engages the bolt and prevents fall-out of the bolt from the open bottom of the case.

In one embodiment of the invention having the structure as set forth in the preceding paragraph, the bolt has a recess opening toward the bottom of the case and a driver in the form of a generally planar member is fixed to the lower end of the shaft and has an arm which fits into said recess to prevent fall-out of the bolt and also convert shaft rotation into linear movement of the bolt.

Another embodiment of the invention is constructed with an over-center feature to prevent retraction of the bolt by force applied directly to the bolt. A slide member is interposed between the driver which is affixed to the shaft and the bolt with the slide member having an arm engageable within the recess of the bolt and the driver and slide member having a pin and slot connection, with the parts related whereby a force applied to the bolt when the bolt is in extended position prevents retraction of the bolt because of the parts being in an over-center condition.

As an additional feature of this embodiment, the pin of the pin and slot connection is defined by a headed member, such as a rivet, which holds the slide member in assembled relation with the driver and as a result causes the slide member to hold the bolt within the case.

DESCRIPTION OF THE PREFERRED EMBODIMENTS

Figure 1:
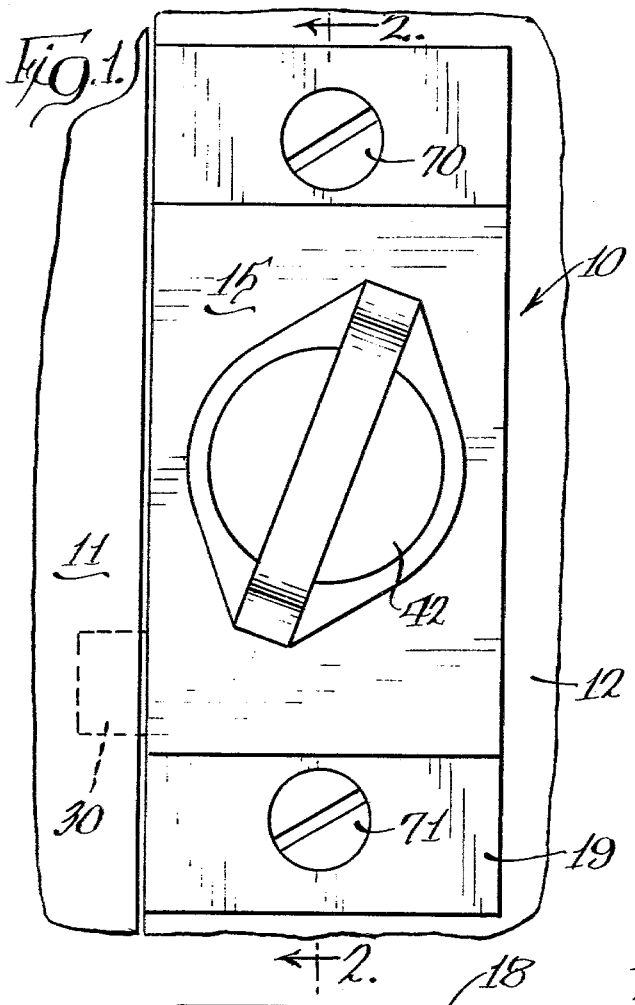
FIG. 1 is a plan view of the security lock shown mounted in association with fragmentarily represented components of a window.

A first embodiment of the invention is shown in FIGS. 1 to 4. The security lock indicated generally at 10 is shown mounted in position for locking of a window 11. With the window 11 being mounted for movement in a plane which is perpendicular to the drawing, the security lock 10 can be mounted on adjacent structure 12 in proper position for causing the bolt thereof to engage a keeper on the frame of the slider window when closed.

The security lock has a case defined by a top wall 15 and two pairs of side walls 16 and 17 and 18 and 19, respectively, with the side wall 19 being of a substantial thickness. The top wall and side wall define a generally hollow interior for the case which opens to the bottom thereof and toward the right, as viewed in FIG. 2.

Figure 2:
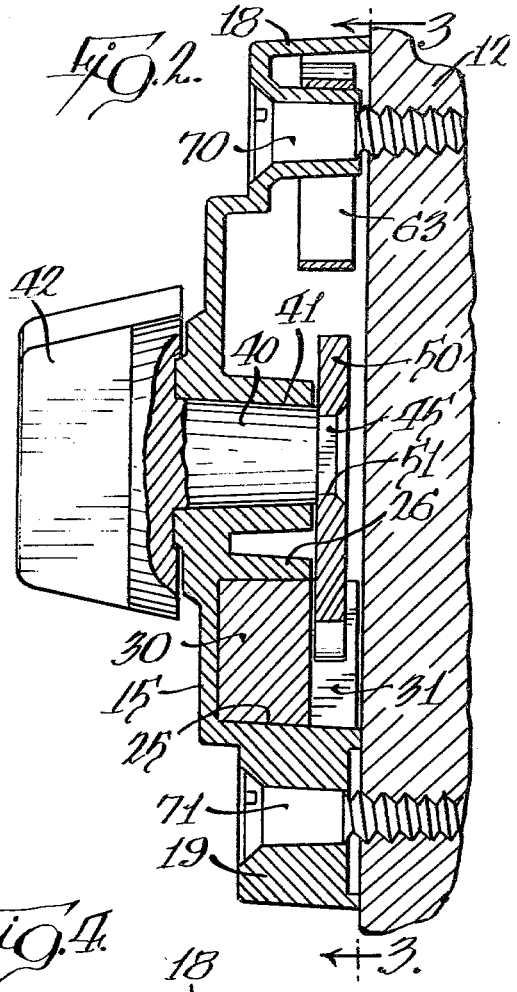
FIG. 2 is a sectional view, taken generally along the line 2—2 in FIG. 1.

A bolt-receiving channel is formed within the case and opens toward the bottom thereof. This channel includes walls formed by a part of the top wall 15, an internal surface 25 of the side wall 19, and an internal wall 26. The case of the security lock can be formed of molded plastic material and, as shown in FIG. 2, the channel has a gradually increasing dimension as it approaches the open bottom of the case as a result of the molding operation. The channel receives a bolt 30 which is movable linearly within the channel between the extended position shown in FIG. 3 and the retracted position shown in FIG. 4. The bolt 30, intermediate its ends, has a recess 31 for association with the structure to be described.

The lock has manually-operable structure for positioning of the bolt including, a shaft 40 rotatably mounted within an opening 41 formed integrally in a part integral with the top wall 15 and with an exposed end of the shaft having an operating knob 42. An end 45 of the shaft 40 is positioned within the case and generally co-planar with the recess 31 of the bolt. A driver 50, in the form of a planar member, has an opening 51 of a generally square shape to fit on the square shaft end 45 and with the shaft end being swaged, as shown at 52, to capture the driver. The driver 50 has an arm 55 which extends into the recess 31 of the bolt.

Figure 3:
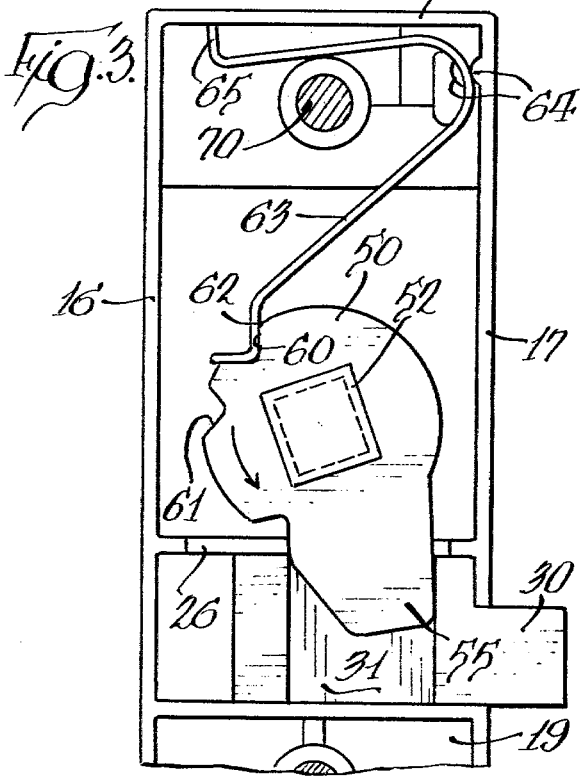
FIG. 3 is a sectional view, taken generally along the line 3—3 in FIG. 2.
Figure 4:
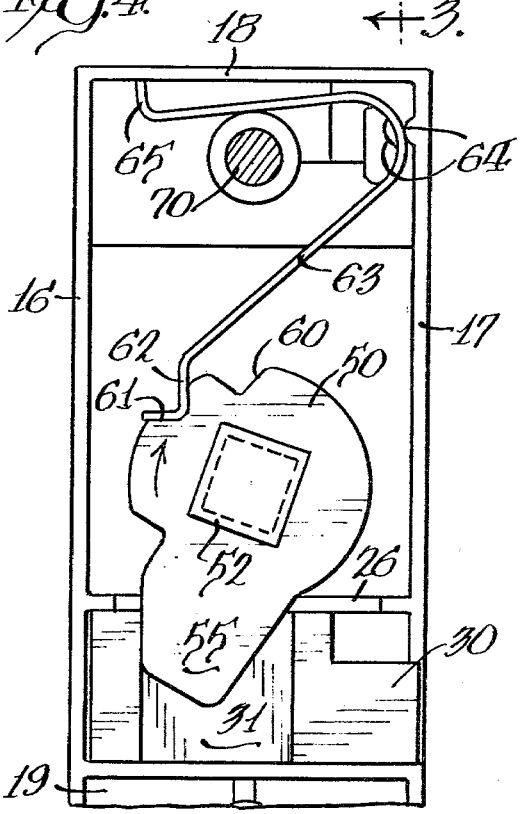
FIG. 4 is a view, similar to FIG. 3, with the bolt shown in retracted position.
Figure 5:
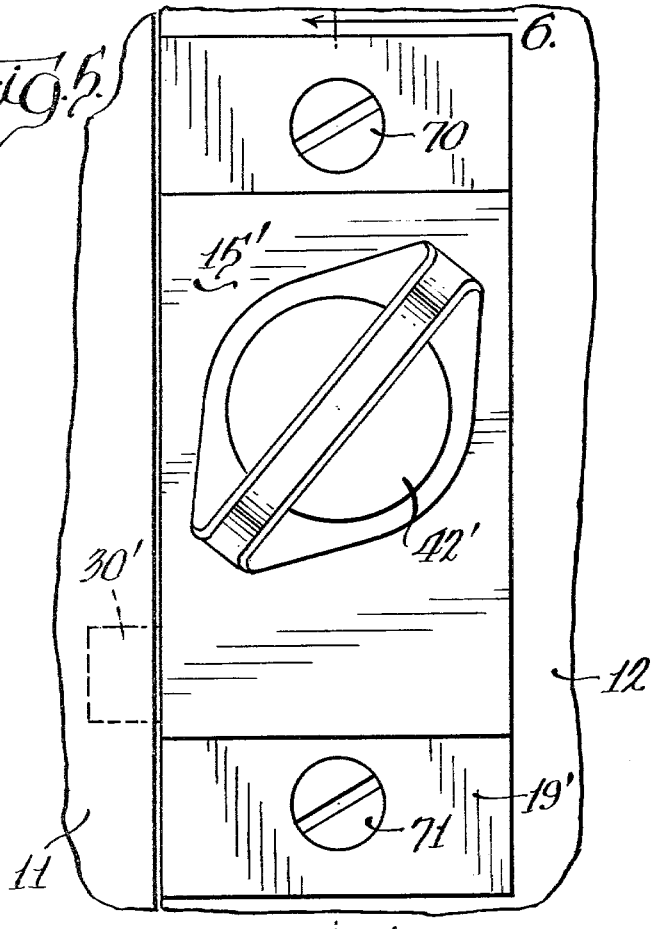
FIG. 5 is a view, similar to FIG. 1, of another embodiment of the invention.
Figure 6:
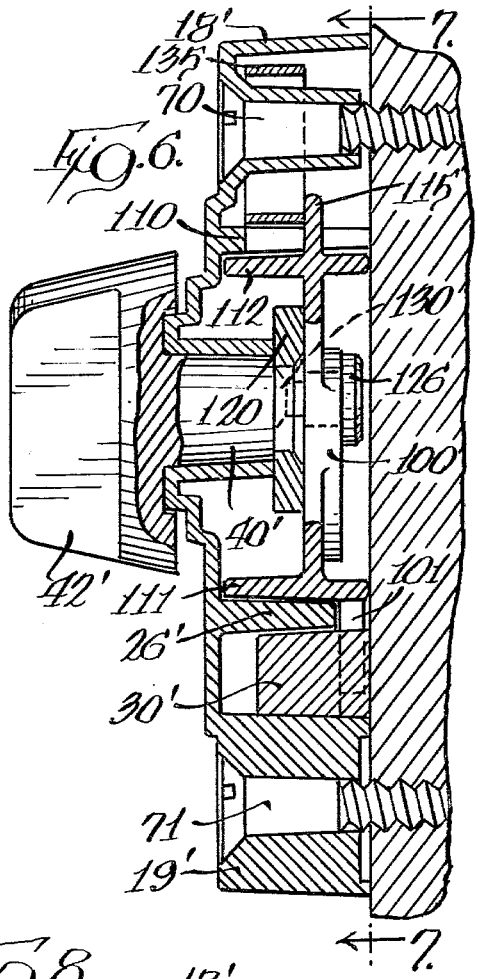
FIG. 6 is a sectional view, taken generally along the line 6—6 in FIG. 5.

The periphery of the driver 50 has a pair of detent surfaces in the form of notches 60 and 61 which co-act with a V-shaped end 62 of a spring member 63 to yieldably hold the driver and, therefore, the bolt 30 in either the extended position, shown in FIG. 3, or the retracted position, shown in FIG. 4. The spring member 63 is suitably captured within the case by surfaces 64 formed within the case and by a spring end 65 engaging the side wall 18 of the case.

The security lock 10 is mounted to a supporting structure 12 by means of a pair of screws 70 and 71 which pass through openings formed in the case.

With the security lock mounted for use, as shown in FIG. 2, it will be seen that the interior of the case opens to the mounting structure 12 and without the presence of any bottom plate for the case. The disclosed structure avoids the need for a bottom plate since, during assembly, the bolt 30 can be positioned in its guide channel and the driver 50 is then moved into position with the arm 55 engaged in the recess 31 and the opening 51 of the driver fitted on the shaft end 45 and, thereafter, the end of the shaft is swaged to retain the driver fixed to the shaft. This assembly method results in the driver capturing the bolt and then the driver being secured to the shaft whereby the parts are retained in position without any bottom plate.

The security lock is shown in an operative position in FIG. 4 wherein the driver is releasably retained in position by the spring member 63 and the bolt 30 is retracted. Manual rotation of the knob 42 causes rotation of the driver 50 and the driver arm 55 engages a wall of the recess 31 formed in the bolt 30 to move the bolt from the position shown in FIG. 4 to the extended position shown in FIG. 3. The parts are yieldably retained in this position by the spring 63. When the bolt is to be retracted, the knob is rotated to return the parts to the position shown in FIG. 4, with the driver arm 55 acting on an opposite wall of the recess 31.

In the embodiment of FIGS. 5 to 8, the security lock has modified structure to provide an over-center action whereby the bolt cannot be forced to a retracted position by force applied by direct engagement with the bolt. In this embodiment, the parts which are the same as those shown in the embodiments of FIGS. 1 to 4 are given the same reference numeral with a prime affixed thereto. The bolt 30′ is the same as the bolt 30, but having a lesser width.

A slide member 100 is mounted within the case and has an arm 101 which is positioned within the recess 31′ of the bolt and transmits linear movement of the slide member to the bolt. The slide member 100 is guided for linear movement by the wall 26′ of the case and a wall 110 thereof which coact with a pair of flanges 111 and 112, respectively, which are formed at opposite ends of the slide member. To retain a spring 135 within the case, there is an additional flange 115 extending outwardly from the flange 112 which engages against the outer edge of the spring.

A driver member 120 is secured to the shaft 40′ by swaging in the same manner as in the embodiment of FIGS. 1 to 4; however, the driver does not directly engage the bolt 30′. The driver transmits rotation of the shaft to the slider member 100 through a pin and slot connection, with there being a slot 125 formed in the slider member 100 and extending in a direction transverse to the path of linear movement of the slider member. The pin of the connection is defined by a rivet 126 having a head 127 which captures and holds the slider member in association with the driver and with the rivet secured to the inner face of the driver, as indicated at 130.

Figure 7:
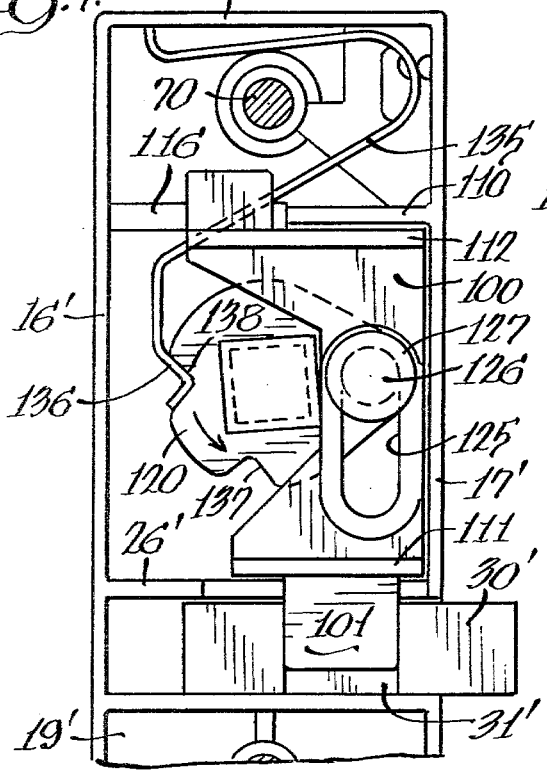
FIG. 7 is a sectional view, taken generally along the line 7—7 in FIG. 6, with the bolt extended.
Figure 8:
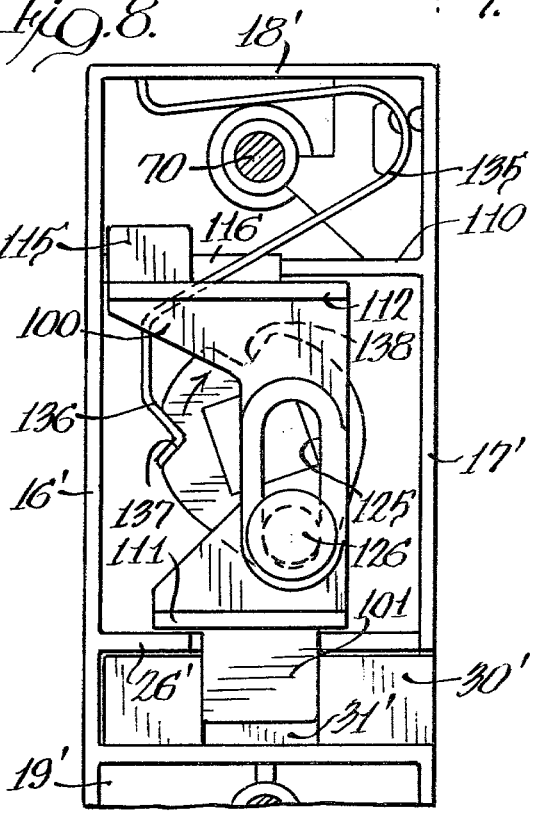
FIG. 8 is a view, similar to FIG. 7, showing the bolt in retracted position.

With this construction, rotation of the driver 120 causes movement of the pin in a counterclockwise direction, as viewed in FIG. 8, to cause movement of the slider member to the position shown in FIG. 7 and resulting in movement of the bolt 30′ to lock position. Movement of the pin in a clockwise direction from the position shown in FIG. 7 to the position shown in FIG. 8 causes retraction of the bolt.

The spring 135, which is held in captured position within the case between the flange 115 and a surface 116 of the wall 110, has a V-shaped end 136 for coacting with a pair of detent surfaces formed by notches 137 and 138 in the periphery of the driver 120 to yieldably hold the bolt in either extended or retracted position.

The operating structure for the bolt is constructed to prevent retraction of the bolt by force applied directly thereto by having the pin carried by the driver moved to an over-center position when the bolt is in extended position. More particularly, the pin 126, when positioned as shown in FIG. 7, is in engagement with an end of the slot 125 and, if a force is applied to the bolt tending to retract the bolt, this force is transmitted to the slider member 100 and acts on the pin to urge the pin to rotate in a counterclockwise direction, as viewed in FIG. 7; however, the pin cannot rotate in this direction since it is in engagement with the end of the slot 125.

In assembly, the driver is swaged to the shaft 45 and the rivet captures the slide member 100 to the driver and the arm 101 of the slide member holds the bolt 30′ in its channel. With this construction, there is no need for a bottom plate to hold the parts.

I claim:

1. A security lock for a movable closure comprising, a case with a top wall and side walls defining a generally hollow interior opening to the bottom of the case, means within the case defining a bolt-receiving channel and opening toward the bottom of the case, a bolt movably mounted in said channel, and a manually-operable structure for positioning of said bolt including a shaft rotatably mounted in said case and means including a member fixed to the shaft for transmitting shaft movement to said bolt and said member being fixed to said shaft in a position whereby said means engages said bolt and prevents fall-out of the bolt from the open bottom of the case, said means for transmitting shaft movement further including a member in addition to the member fixed to the shaft, and a movable connection therebetween which moves to an over-center locked condition when the bolt is in the extended lock position.

2. A security lock as defined in claim 1 wherein said movable connection comprises a pin and slot connection with the pin carried by the member fixed to the shaft for movement in an arcuate path by shaft rotation and the other member having the slot.

3. A security lock as defined in claim 2 wherein said pin engages an end of the slot when the bolt is in the extended lock position and the pin is oriented relative to the shaft whereby a retracting force applied directly to the bolt acts to maintain the pin engaged against said end of the slot, and said other member being immovably mounted relative to a force applied against said end of the slot.

4. A security lock for a movable closure comprising, a case with a top wall and side walls defining a generally hollow interior opening to the bottom of the case, means within the case defining a bolt-receiving channel and opening toward the bottom of the case, a bolt movably mounted in said channel, and a manually-operable structure for positioning of said bolt including a shaft rotatably mounted in said case and means including a member fixed to the shaft for transmitting shaft movement to said bolt and said member being fixed to said shaft in a position whereby said means engages said bolt and prevents fall-out of the bolt from the open bottom of the case, said member fixed to the shaft having a pair of detent surfaces and a spring member mounted within the case and engageable with one or the other of said detent surfaces to maintain the bolt either extended or retracted.

5. A security lock comprising, a case with a top wall and side walls defining a generally hollow interior opening to the bottom of the case, means within the case defining a bolt-receiving channel which opens toward the bottom of the case, a bolt mounted in the channel for movement between extended and retracted positions and having a recess intermediate the ends thereof which opens toward the bottom of the case and which is less than the thickness of the bolt to leave a section of the bolt thereabove, and manually-operable structure for positioning of said bolt including a shaft rotatable in said case, and a driver operable by said shaft and having an arm extending transversely from said shaft, said driver being fixed to said shaft in a position to have said arm extend laterally into said recess beneath said bolt section to retain the bolt in the channel against movement toward said bottom as well as convert shaft rotation to linear movement of the bolt.

6. A security lock as defined in claim 5 wherein said driver is a planar member with an opening to fit on a part of the shaft which is at the level of said recess whereby, in assembly, the bolt is first placed in the channel and thereafter the driver is associated with the shaft and the bolt, and means fastening the driver to the shaft.

7. A security lock comprising, a case with a top wall and side walls defining a generally hollow interior opening to the bottom of the case, means within the case defining a bolt-receiving channel which opens toward the bottom of the case, a bolt mounted in the channel for movement between extended and retracted positions and having a recess intermediate the ends thereof which opens toward the bottom of the case, and manually-operable structure for positioning of said bolt including a slide member movably guided in said case and having an arm engageable in said recess, a rotatable shaft having a driver affixed to an end thereof within the case, a pin and slot drive connection between said driver and slide member to convert shaft rotation into linear movement of said bolt with said pin being defined by a rivet with a head which captures said slide member and holds the slide member in association with the driver.

8. A security lock as defined in claim 7 wherein said pin follows an arcuate path in response to shaft rotation and said slot extends in a direction transverse to the path of movement of the slide member, said pin being at an end of the slot when the bolt is extended and positioned relative to the axis of shaft rotation whereby a retracting force applied directly to the bolt exerts a force through the slide member urging the pin to rotate in a direction which is prevented by the pin engaging said end of the slot.

9. A security lock comprising, a case with a top wall and side walls defining a generally hollow interior opening to the bottom of the case, means within the case defining a bolt-receiving channel which opens toward the bottom of the case, a bolt mounted in the channel for movement between extended and retracted positions and having a recess intermediate the ends thereof which opens toward the bottom of the case, and manually-operable structure for positioning of said bolt including a slide member movably guided in said case and having an arm engageable in said recess, a rotatable shaft having a driver affixed to an end thereof within the case, and a pin and slot drive connection between said driver and slide member to convert shaft rotation into linear movement of said bolt including a pin carried by said driver and a slot in said slide member which extends generally in a direction transverse to the path of movement of the slide member, said pin following an arcuate path in response to shaft rotation and being at an end of the slot when the bolt is extended and positioned relative to the axis of shaft rotation whereby a retracting force applied directly to the bolt exerts a force through the slide member urging the pin to rotate in a direction which is prevented by the pin engaging said end of the slot.

* * * * *